US006756771B1

(12) United States Patent
Ball et al.

(10) Patent No.: US 6,756,771 B1
(45) Date of Patent: Jun. 29, 2004

(54) POWER FACTOR CORRECTION METHOD WITH ZERO CROSSING DETECTION AND ADJUSTABLE STORED REFERENCE VOLTAGE

(75) Inventors: Alan R. Ball, Gilbert, AZ (US); Jefferson W. Hall, Chandler, AZ (US)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 0 days.

(21) Appl. No.: 10/465,733

(22) Filed: Jun. 20, 2003

(51) Int. Cl.[7] ..... G05F 1/00

(52) U.S. Cl. ..... 323/222; 323/235; 323/284; 323/288

(58) Field of Search ..... 323/222, 207, 323/208, 209, 282, 288, 284, 285, 235

(56) References Cited

U.S. PATENT DOCUMENTS

| | | | | |
|---|---|---|---|---|
| 5,134,355 A | | 7/1992 | Hasgings | |
| 5,359,281 A | | 10/1994 | Barrow et al. | |
| 5,502,370 A | | 3/1996 | Hall et al. | |
| 5,790,395 A | * | 8/1998 | Hagen | 363/89 |
| 5,818,707 A | * | 10/1998 | Seong et al. | 363/89 |

* cited by examiner

*Primary Examiner*—Shawn Riley
(74) *Attorney, Agent, or Firm*—Robert F. Hightower

(57) ABSTRACT

A power factor correction device (26, 75) stores the output of an error amplifier (32) on a storage element (39). A zero crossing detector (37) detects the zero crossings of the AC input voltage and enables the power factor correction device (26, 75) to adjust the value of the voltage stored on the storage element (39).

20 Claims, 6 Drawing Sheets

POWER FACTOR CORRECTION METHOD WITH ZERO CROSSING DETECTION AND ADJUSTABLE STORED REFERENCE VOLTAGE

BACKGROUND OF THE INVENTION

The present invention relates, in general, to electronics, and more particularly, to methods of forming semiconductor devices and structure.

In the past, the semiconductor industry utilized various structures and methods to form power factor correction circuits. The power factor was generally recognized as a measure of the difference between the voltage and current waveforms of an alternating current (AC) waveform. Differences between the current and voltage waveforms resulted in low efficiency utilization of the supplied AC power. Power factor correction circuits were utilized to more closely align the shape of the current and voltage waveforms in order to provide higher efficiency. Examples of power factor correction circuits are disclosed in U.S. Pat. No. 5,134,355 issued to Roy Alan Hastings on Jul. 28, 1992; U.S. Pat. No. 5,359,281 issued to Barrow et al on Oct. 25, 1994; and U.S. Pat. No. 5,502,370 issued to Hall et al on Mar. 26, 1996 all of which are hereby incorporated herein by reference.

FIG. 1 illustrates a simplified schematic of a portion of a prior art power factor correction circuit 100 that had some similar functionality to the above referenced patents. Circuit 100 received an AC input voltage on inputs 112 and 113 and operated a switching transistor 101 to generate a DC output voltage on outputs 117 and 118. An error amplifier 102 and multiplier 103 operated together to form an AC reference voltage on an output 104 of multiplier 103. A current shaping block and a logic and control section used the AC reference voltage to control transistor 101. The control signals to transistor 101 were designed to modify the input current from inputs 112 and 113 in a manner that made the shape of the input current waveform closely match the shape of the input voltage waveform in order to provide a power factor that approached a unity value.

One problem with the previous power factor control circuits was the transient response time. In order to provide low distortion in the input current waveform, the control loop of circuit 100 had a very slow response time. In order to prevent input noise from affecting the output voltage, the bandwidth of the control loop generally was about ten times less than the frequency of the rectified AC input voltage. Typically the bandwidth was limited to about ten to twelve Hz (10–12 Hz). Because of the low bandwidth of the control loop and the low bandwidth resulting from the compensation of amplifier 102, circuit 100 had a slow response to transient voltages on inputs 112 and 113 which often resulted in an over-voltage or under-voltage condition at outputs 117 and 118. The over-voltage condition could result in damage to the load connected to outputs 117 and 118, while the under-voltage condition could result in shutdown of the load. Such transients often occurred and were very common at start-up.

Accordingly, it is desirable to have a method of forming a power factor correction device that has a wider loop bandwidth, that has an error amplifier that quickly responds to transients, and that provides greater protection for loads connected to the power factor correction device.

BRIEF DESCRIPTION OF THE DRAWINGS

For simplicity and clarity of illustration, elements in the figures are not necessarily to scale, and the same reference numbers in different figures denote the same elements. Additionally, descriptions and details of well known steps and elements are omitted for simplicity of the description.

DETAILED DESCRIPTION OF THE DRAWINGS

Figure 1:
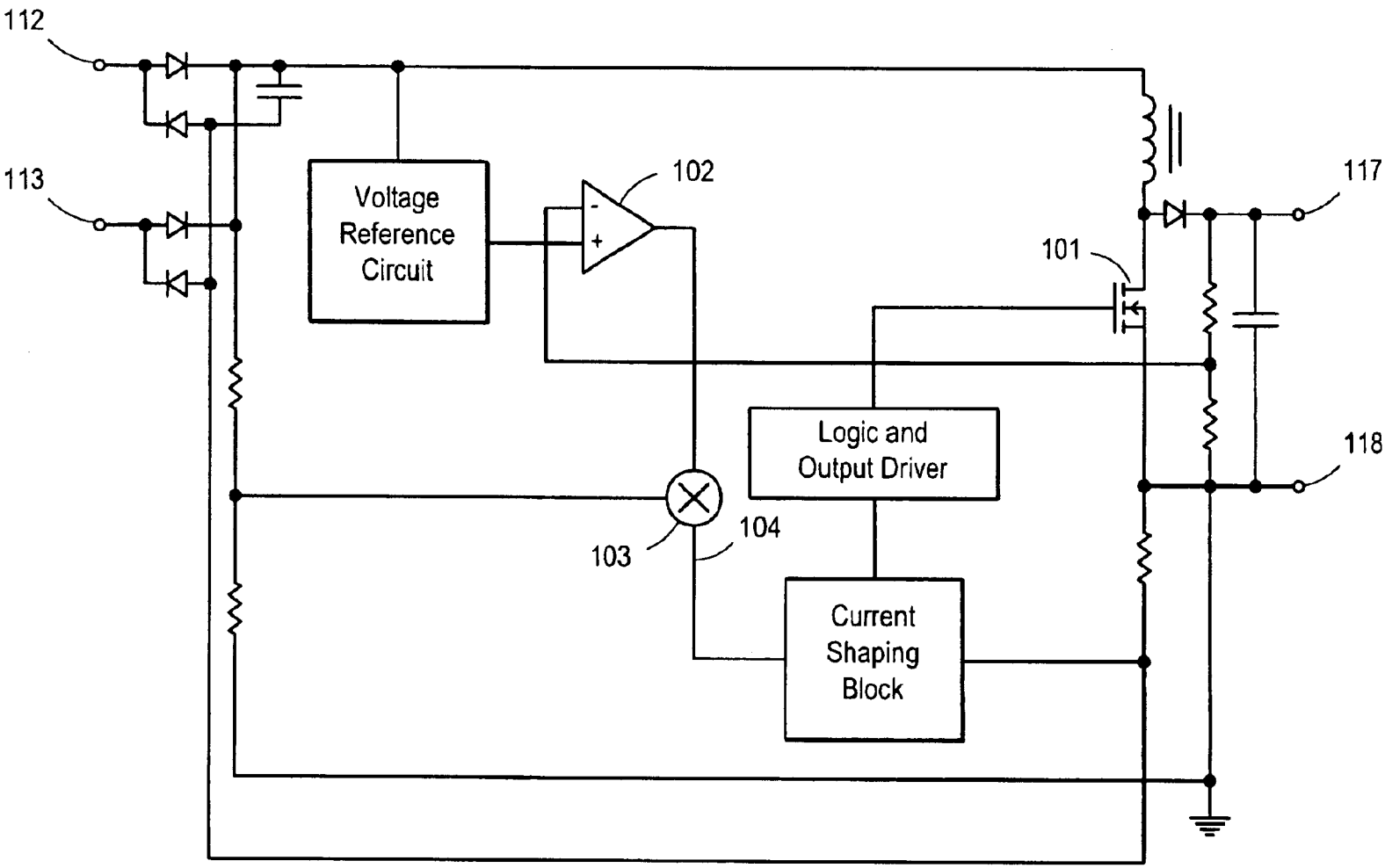
FIG. 1 Prior Art
FIG. 1 illustrates a simplified schematic of a portion of a prior art power factor correction circuit.
Figure 2:
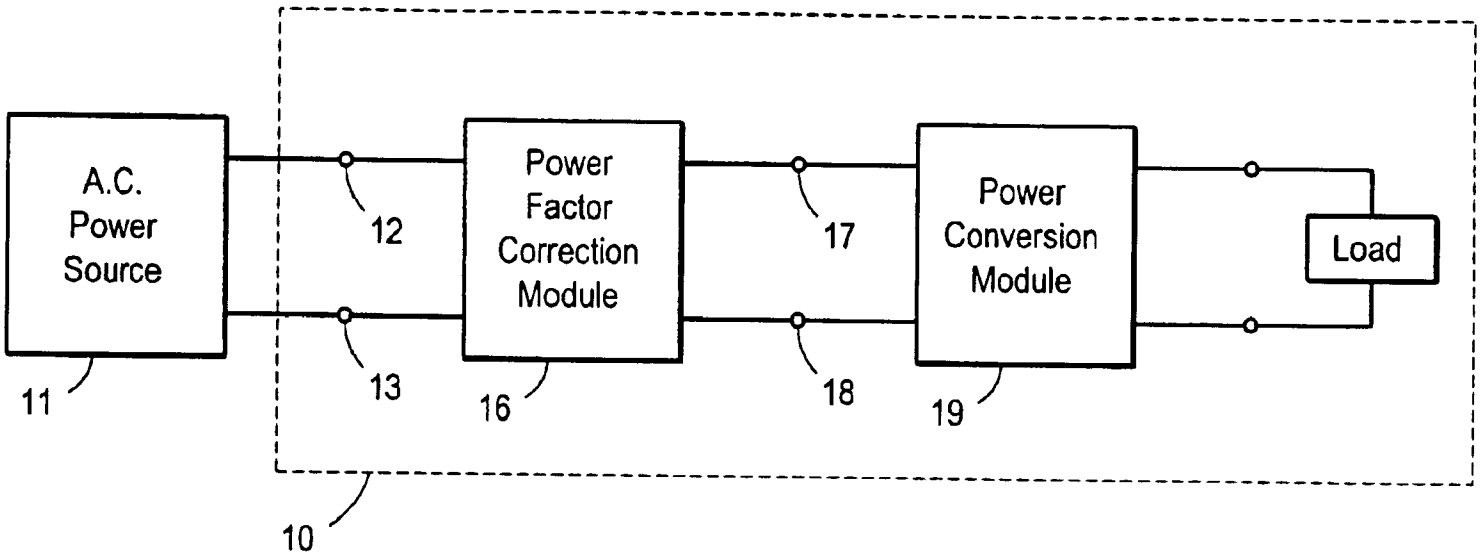
FIG. 2 schematically illustrates a block diagram of an embodiment of a power system in accordance with the present invention.

FIG. 2 schematically illustrates a simplified block diagram of a power system 10 that includes a power factor control function. Power system 10 receives an AC voltage and current from an AC power source 11 such as a standard office or home AC line outlet. The AC power is received on inputs 12 and 13 of a power factor control module 16. Module 16 typically provides a DC voltage and current on outputs 17 and 18. A power conversion module 19 receives the DC voltage and converts the DC voltage to an output voltage that is suitable for driving a load. Module 19 may be a variety of linear or non-linear power conversion modules such as a switching power supply controller, a pulse width modulated (PWM) controller, a buck converter, or a boost converter. Module 16 adjusts the power factor of the incoming AC power in order to provide high efficiency power conversion. System 10 may be a power system of various applications including a power supply section of a computer system, a personal computer, or other electronic system.

Figure 3:
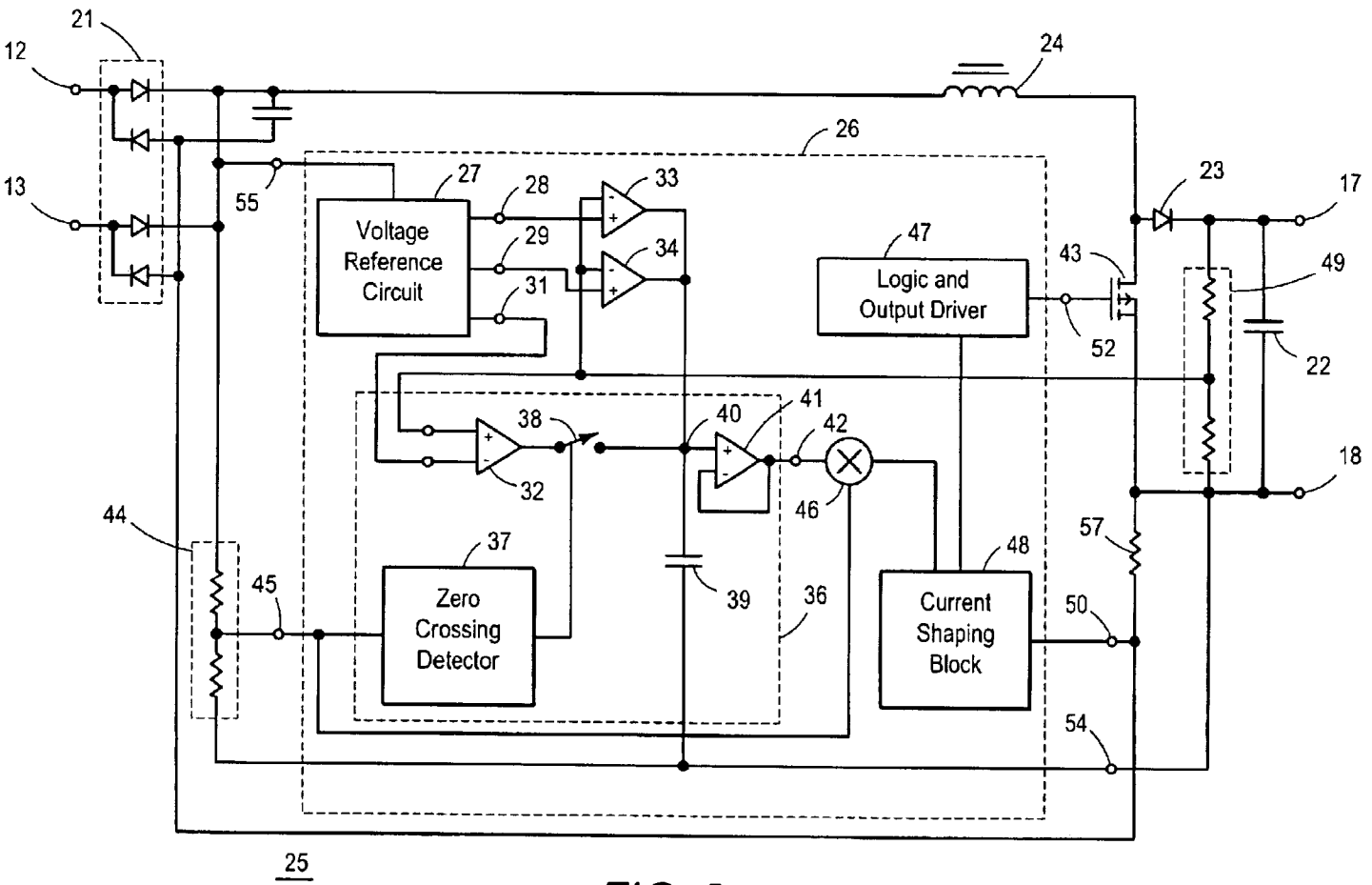
FIG. 3 schematically illustrates a portion of an embodiment of a power factor correction device in accordance with the present invention.

FIG. 3 schematically illustrates a portion of an embodiment of a power factor correction module 25 that functions similarly to module 16 that is illustrated in FIG. 2. Module 25 includes a power factor correction circuit or power factor correction device 26 that functions to adjust the shape of the waveform of the incoming input AC current to closely match the waveform of the input AC voltage. Module 25 receives an AC input signal on inputs 12 and 13, and provides a DC output voltage and current on outputs 17 and 18. A rectifier 21 of module 25 rectifies the AC input signal and provides a full wave rectified AC input voltage to a switching transistor 43 and to a voltage input 55 of device 26. An inductor 24 connected between rectifier 21 and transistor 43 functions as an energy storage element that assists filtering the rectified AC input voltage. Power factor correction device 26 operates transistor 43 to generate the DC output voltage on outputs 17 and 18, and to adjust the shape of the input current received at inputs 12 and 13. A feedback network 49 provides a feedback voltage that is representative of the value of the output voltage on outputs 17 and 18. A filter capacitor 22 typically is connected between outputs 17 and 18 to reduce noise and ripple in the output voltage. An input voltage divider 44 forms an AC sense signal that has the same shape as the AC input voltage but has a lower amplitude, thus, the AC sense signal is representative of the AC input voltage. The AC sense signal is applied to a sense signal input 45 of device 26. A current sense input 50 receives a current sense signal that represents the value of the AC input current. The current sense signal is derived from the current through a current sense resistor 57 that is connected between output 18 and rectifier 21. Output 18 is also connected to a voltage return 54 of device 26. Output 18 and voltage return 54 form a common potential for module 25 and often is used as a ground reference potential. Rectifier 21, feedback network 49, and divider 44 are illustrated by dashed boxes.

Power factor correction device 26 includes a sample-and-hold error voltage generator 36, a voltage reference circuit 27, an over-voltage amplifier 33, an under-voltage amplifier 34, an analog reference multiplier 46, a current shaping block 48, and a logic and output driver section 47. Sample-and-hold error voltage generator 36 includes an error amplifier 32, an analog switch 38, a storage element 39, an amplifier 41, and a zero crossing detector 37. Sample-and-hold error voltage generator 36 is formed to have a bandwidth that is no less than, and preferably is approximately equal to, the frequency of the AC sense signal applied to input 45. This frequency is hereinafter referred to as the zero crossing frequency. Typically the zero crossing frequency has a value that is no less than and preferably is approximately equal to twice the frequency of the AC input signal applied to inputs 12 and 13. In other embodiments it may have other values.

In operation, error amplifier 32 is formed to receive both the first reference voltage from circuit 27 and the feedback voltage formed by feedback network 49, and to responsively generate a deviation voltage on an output of amplifier 32. The deviation voltage is representative of the deviation of the output voltage value from the desired output voltage value. Detector 37 is formed to detect each zero crossing of the AC sense signal applied to input 45 and responsively enable switch 38 to connect the output of amplifier 32 to storage element 39 in order to store or adjust the value of the deviation voltage on element 39 at each zero crossing of the AC sense signal. In the preferred embodiment, the AC sense signal is representative of the AC input signal, thus, switch 38 is enabled at each zero crossing of the AC input signal applied to inputs 12 and 13. Detector 37 typically enables switch 38 within at least ten to twenty degrees of each zero crossing. It is important to enable switch 38 substantially during the zero crossing because the output of multiplier 46 has a zero value during this time, thus, changing the value of node 40 during this time does not have a detrimental effect on the output voltage or the power control function. In the preferred embodiment, detector 37 detects each zero crossing and enables switch 38 within no greater than about three degrees of the zero crossing. Switch 38 can be a variety of well known electronic switches and preferably is a metal oxide semiconductor (MOS) coupler device. Such zero crossing detectors and switches are well known to those skilled in the art. Amplifier 41 is formed to receive the stored value of the deviation voltage from storage element 39 and responsively form an error voltage on an output 42 of generator 36. Preferably, amplifier 41 is formed as a unity gain buffer that has a high input impedance in order to prevent disturbing the value of the deviation voltage stored on element 39. Amplifier 41 generally has an input current of less than ten nano-amps. In other embodiments the gain of amplifier 41 may be different.

Multiplier 46 receives the value of the error voltage from output 42 and multiplies the value of the AC sense signal by the value of the error voltage in order to form an AC reference signal on an output of multiplier 46. The AC reference voltage has the same shape as the waveform of the AC input voltage but has an amplitude that is adjusted by the value of the error voltage. Current shaping block 48 receives the. AC reference voltage from multiplier 46 and receives the current sense signal from input 50 and responsively controls driver section 47. The functions of current shaping block 48, logic and output driver section 47, and transistor 43 are well known to those skilled in the art.

Because generator 36 is sampling the deviation voltage at a frequency of no less than twice the frequency of the AC input signal applied to inputs 12 and 13, the bandwidth of generator 36 is limited to this frequency, thus, amplifier 32 can have a much wider uncompensated bandwidth. The uncompensated bandwidth of amplifier 32 generally is between one and ten MHz (1–10 MHz) but may be wider. The wide bandwidth of amplifier 32 allows the bandwidth of generator 36 to be controlled by the zero crossing frequency of the signal applied to detector 37. Additionally, the wide bandwidth of amplifier 32 ensures that the output of amplifier 32 quickly changes the deviation voltage as the output voltage varies thereby providing a more accurate output voltage value. Because of the wide bandwidth of amplifier 32, the output signal of amplifier 32 may have some ripple. However, the value of the deviation voltage is only stored at the zero crossings consequently this ripple is removed. The wide bandwidth of amplifier 32 and of generator 36 provides a fast control loop response that can quickly respond to changes in the output voltage or current due to demands from the load. Device 26 typically provides a response to changes in the output voltage that is ten to twenty (10–20) times faster than prior art power factor correction circuits. Those skilled in the art will note that amplifier 32 typically will have some external compensation that limits the closed loop bandwidth of amplifier 32 to something that is less than the uncompensated bandwidth but typically is still no less than the zero crossing frequency.

Over-voltage amplifier 33 receives both a second reference voltage from circuit 27 and the feedback voltage and generates an output signal when the value of the output voltage exceeds the desired upper limit value. The output of amplifier 33 is connected to storage node 40 and changes the value of the deviation voltage stored on element 39 when the value of the output voltage exceeds the desired upper limit. Similarly, under-voltage amplifier 34 receives both a third reference voltage from circuit 27 and the feedback voltage and responsively provides an output signal when the value of the output voltage is less than the desired lower limit. The output of amplifier 34 is also connected to node 40 and changes the value of the deviation voltage stored on element 39 when the value of the output voltage is less than the desired lower value. The new stored voltage resulting from over-voltage or under-voltage condition quickly changes the AC reference voltage and the corresponding control voltage to transistor 43 to modify the value of the output voltage. The response to such transients is not limited by the bandwidth of amplifier 32 nor by the sampling rate of generator 36. It should be noted that at the next zero crossing, the value of the deviation voltage will be restored on element 39, thus, the over-voltage or under-voltage modification is very brief (generally no greater than one-half of a cycle). Forming the over-voltage and under-voltage circuits to change the value the stored value of the deviation voltage provides a method of quickly responding to the over or under voltage condition without being limited by the bandwidth of the error amplifier. In order to prevent the output of amplifiers 33 and 34 from affecting the voltage value stored on element 39 during periods of normal operation, the output drivers of amplifiers 33 and 34 are formed as a sink only and a source only stage, respectively. Thus, amplifiers 33 and 34 are formed to generate an output current only during an over or under voltage event, respectively. Those skilled in the art will recognize that amplifiers 33 and 34 may also be formed as comparators.

Figure 4:
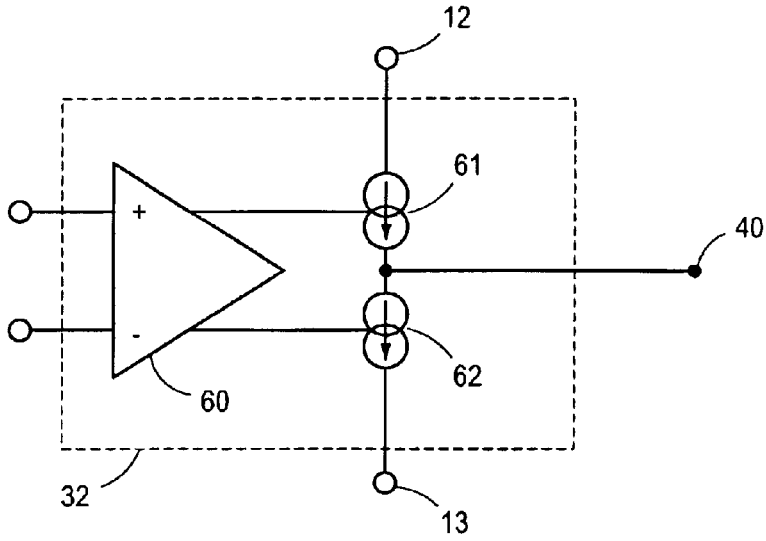
FIG. 4 schematically illustrates a portion of an embodiment of an error amplifier of the power factor correction device of FIG. 3 in accordance with the present invention.

FIG. 4 schematically illustrates a preferred embodiment of portions of amplifier 32 that is illustrated in FIG. 3. Amplifier 32 typically includes a differential amplifier 60 and an output stage. In this preferred embodiment, amplifier 32 is a transconductance amplifier and the output stage includes a current source 61 and a current sink 62 that have current output and input, respectively, values that are controlled by the differential outputs of amplifier 60. Using a transconductance amplifier facilitates quickly charging or discharging element 39 when switch 38 is enabled.

Referring back to FIG. 3, amplifier 32 has an inverting or first input connected to a first output 31 of circuit 27, a second input or non-inverting input connected to feedback network 49, and an output connected to a first terminal of switch 38. Detector 37 has an input connected to input 45 to receive the AC sense signal, and an output connected to a control electrode of switch 38. A second terminal of switch 38 is connected to storage node 40. Storage element 39 has a first terminal connected to node 40 and a second terminal connected to voltage return 54. Amplifier 41 has a non-inverting terminal or first terminal connected to node 40, and an output connected to a second input terminal of amplifier 41. Over-voltage amplifier 33 has a non-inverting input or first input connected to a second output 28 of circuit 27, an inverting input or second input connected to feedback network 49, and an output connected to node 40. Under-voltage amplifier 34 has a non-inverting input or first input connected to a third output 29 of circuit 27, an inverting input or second input connected to feedback network 49, and an output connected to node 40. Multiplier 46 has a first input connected to output 42 of generator 36, a second input connected to input 45, and an output connected to an input of block 48.

Figure 5:
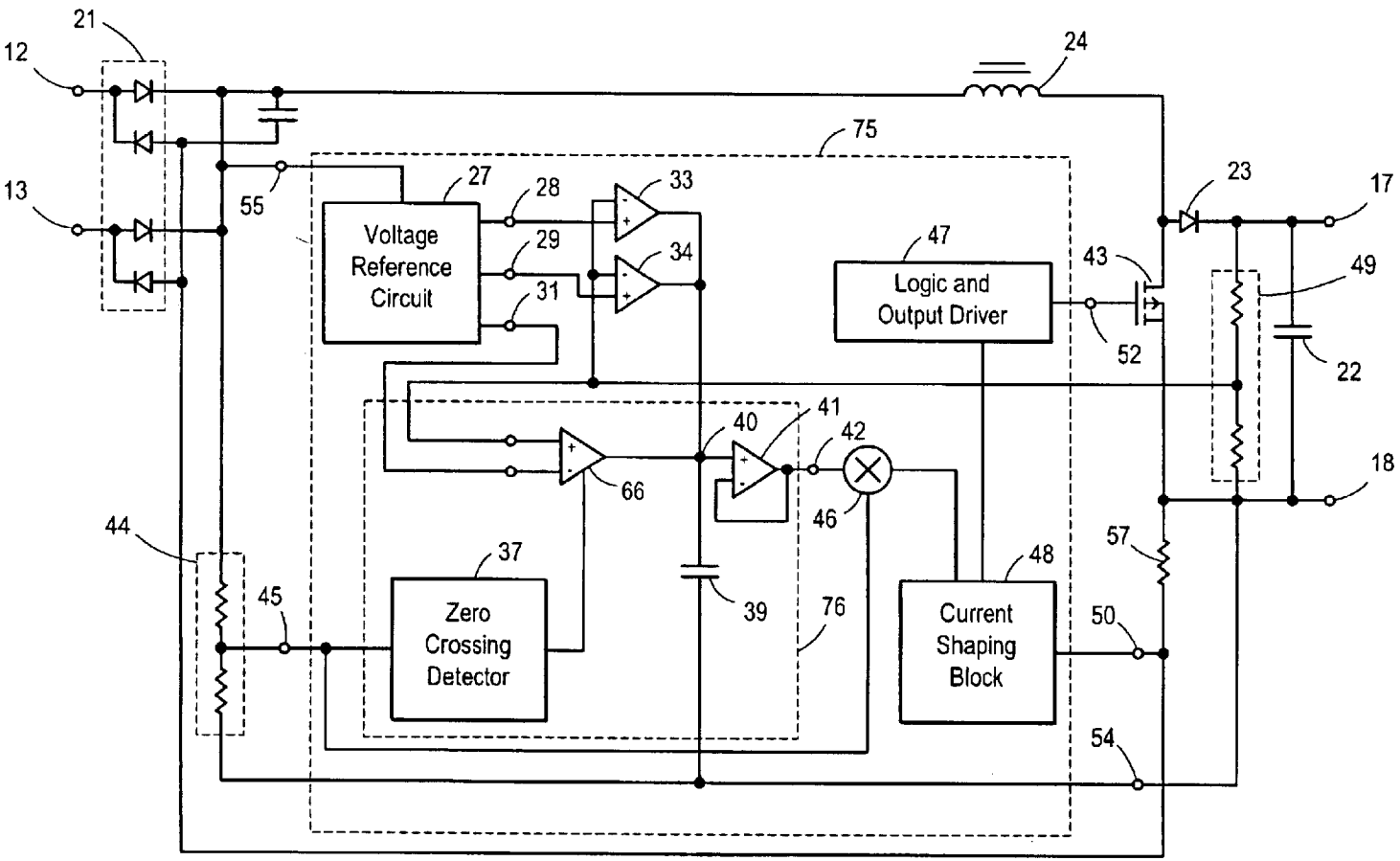
FIG. 5 schematically illustrates a portion of another embodiment of a power factor correction device in accordance with the present invention.

FIG. 5 schematically illustrates a portion of an embodiment of a power factor correction module 65 that is an alternate embodiment of module 25 that is illustrated in FIG. 3. Module 65 includes a power correction device 75 and an error voltage generator 76 that respectively replace device 26 and generator 36. Generator 76 utilizes an error amplifier 66 that has a selectable output stage as will be seen in more detail hereinafter.

Figure 6:
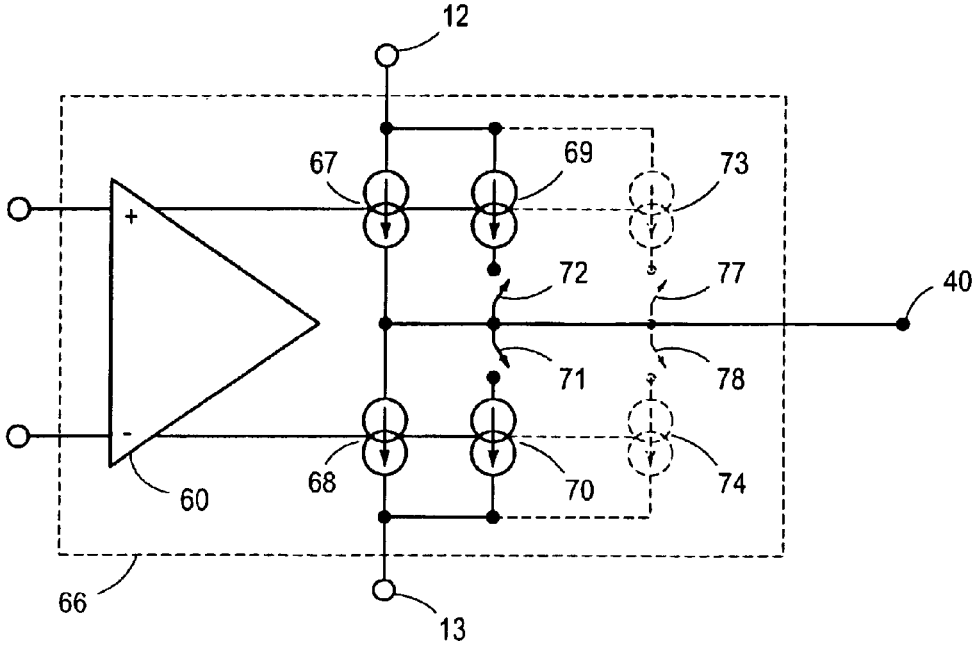
FIG. 6 schematically illustrates a portion of an embodiment of an error amplifier of the power factor correction device of FIG. 5 in accordance with the present invention.

FIG. 6 schematically illustrates a preferred embodiment of portions of amplifier 66 that is illustrated in FIG. 5. For clarity, this description will have references to both FIG. 5 and FIG. 6. Amplifier 66 is formed to receive both the first reference voltage from circuit 27 and the feedback voltage from network 49, and to responsively generate the deviation voltage on an output of amplifier 66. Amplifier 66 preferably is formed as a transconductance amplifier that has a differential amplifier stage and an output stage having a plurality of sink only current sources and a plurality of source only current sources. A variable source only current source 67 and a variable sink only current source 68 are controlled by the differential outputs of amplifier 60 similarly to sources 61 and 62 illustrated in FIG. 4. Amplifier 66 also has a plurality of selectable current sources including a selectable source only current source 69 and a selectable sink only current source 70 that are selectively switched or enabled in parallel with sources 67 and 68, respectively, by detector 37 during the zero crossing of the AC input signal. Switches 71 and 72 are enabled by detector to implement the switchable parallel connection. Switches 72 and 71 are similar to switches 38 shown in FIG. 3. The current capacity of sources 69 and 70 are controlled by the differential outputs of amplifier 60. During the zero crossing, detector 37 enables switches 71 and 72, and sources 67, 68, 69, and 70 adjust the value of the error voltage on element 39 in response to the inputs to amplifier 66. Sources 67 and 68 have smaller current values than sources 69 and 70 so that when switches 71 and 72 are not enabled sources 67 and 68 are controlled by amplifier 60 to change the value of the deviation voltage stored on element 39. Sources 69 and 70 generally have a current capacity of at least twice the capacity of source 67 and 68 and preferably at least ten times the capacity. Forming amplifier 66 to have a selectable output stage maintains the deviation voltage value on the output of amplifier 66 and minimizes the voltage range over which the output must slew when detector 37 enables amplifier 66. Since the output of amplifier 66 is always connected in the control loop of module 65 the feedback is maintained thereby maintaining the control provided by module 65.

In order to facilitate this operation, amplifier 66 has an inverting or first input connected to a first output 31 of circuit 27, a second input or non-inverting input connected to feedback network 49, an output connected to node 40, and a switch control input connected to the output of detector 37.

Figure 7:
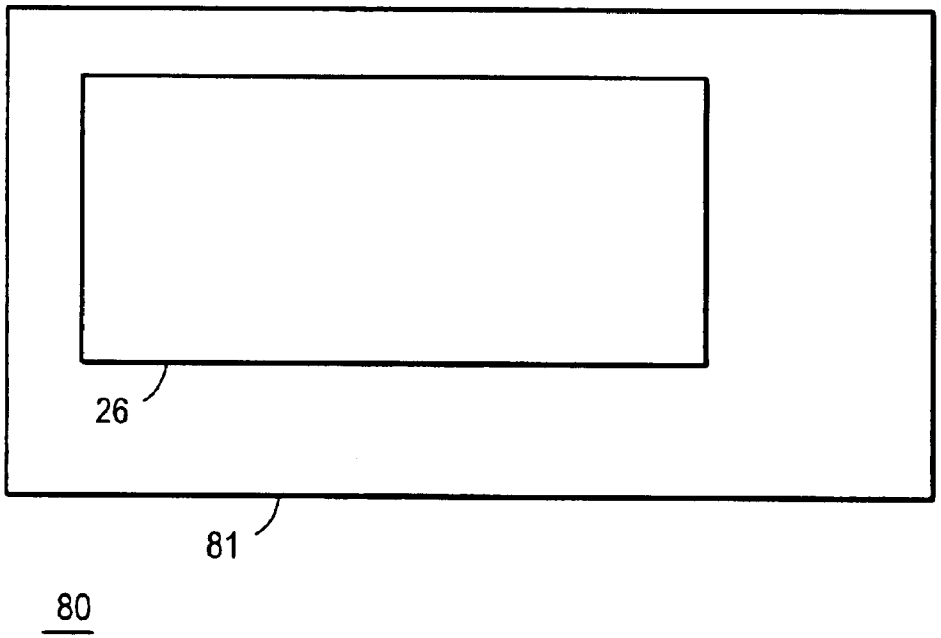
FIG. 7 schematically illustrates an enlarged plan view of a semiconductor device that includes the power factor correction device of FIG. 3 in accordance with the present invention.

FIG. 7 schematically illustrates an enlarged plan view of a portion of an embodiment of a semiconductor device 80 that is formed on a semiconductor die 81. Power factor correction device 26 is formed on die 81.

In view of all of the above, it is evident that a novel device and method is disclosed. Forming the power factor correction device to sample the output of the error amplifier at a frequency no less than twice the input frequency allows the error amplifier to have a wide bandwidth while limiting the control loop bandwidth to a frequency no greater than twice the input frequency. Coupling the over-voltage and under-voltage comparators to adjust the stored value from the error amplifier when the over or under-voltage condition occurs results a response to such conditions that is at least ten times fast than the response provided by prior power factor control circuits.

What is claimed is:

1. A method of forming a power factor correction device comprising:

forming the power factor correction device to receive an AC voltage;

forming an error amplifier of the power factor correction device to generate a deviation voltage representative of a difference between an output voltage of a power factor correction system and a desired output voltage;

forming a storage element to receive a value of the deviation voltage and to form a stored voltage on the storage element; and forming a zero crossing detector to detect a zero crossing of the AC voltage and to responsively enable adjusting a value of the stored voltage including forming the zero crossing detector to responsively couple the deviation voltage to the storage element during the zero crossing.

2. The method of claim 1 wherein forming the zero crossing detector to detect the zero crossing of the AC voltage and to responsively enable adjusting a value of the stored voltage includes adjusting the value of the stored voltage within no greater than twenty degrees of the zero crossing of the AC voltage.

3. The method of claim 1 wherein coupling the output of the error amplifier to the storage element at the zero crossing of the AC voltage includes enabling a switch to couple the output of the error amplifier to the storage element at the zero crossing.

4. The method of claim 1 wherein forming the zero crossing detector to detect the zero crossing of the AC voltage and to responsively enable adjusting the value of the stored voltage includes forming the zero crossing detector to responsively enable the error amplifier to couple a plurality of variable current sources to an output of the error amplifier during the zero crossing.

5. The method of claim 4 wherein forming the zero crossing detector to responsively enable the error amplifier to couple the plurality of variable current sources to the output of the error amplifier during the zero crossing includes forming the error amplifier to have an output stage that includes a plurality of selectable current sources in parallel with a plurality of variable current sources.

6. The method of claim 1 further including forming an over-voltage amplifier to generate a voltage representative of a difference between the output voltage and a desired upper limit of the output voltage and coupling an output of the over-voltage amplifier to the storage element.

7. The method of claim 1 further including forming an under-voltage amplifier to generate a current representative of a difference between the output voltage and a desired lower limit of the output voltage and coupling an output of the under-voltage amplifier-to the storage element.

8. A power factor correction method comprising:

receiving an AC voltage;

storing a value of an output of an error amplifier on a storage element to form a stored voltage;

detecting a zero crossing of the AC voltage and responsively adjusting the stored voltage;

using the stored voltage as an error voltage; and using the error voltage to form an AC reference voltage of a power factor correction circuit.

9. The method of claim 8 wherein sampling and storing the value of the output of the error amplifier includes forming a deviation voltage representative of a difference between an output voltage of a power factor correction module and a desired output voltage and storing a value of the deviation voltage.

10. The method of claim 9 wherein forming the deviation voltage representative of the difference between the output voltage of the power factor correction module and the desired output voltage includes forming a feedback voltage representative of the output voltage and comparing the feedback voltage to a reference voltage to form the deviation voltage.

11. The method of claim 9 wherein storing the value of the deviation voltage includes coupling the deviation voltage to a storage element at the zero crossing of the AC voltage.

12. The method of claim 9 wherein storing the value of the deviation voltage includes coupling the deviation voltage to a storage element during the zero crossing and decoupling the deviation voltage from the storage element after the zero crossing.

13. The method of claim 8 wherein using the stored voltage as the error voltage includes amplifying the stored voltage to form the error voltage.

14. The method of claim 8 wherein using the stored voltage as the error voltage includes amplifying the stored voltage with a unity gain buffer to form the error voltage.

15. The method of claim 8 further including changing a value of the stored voltage during an over-voltage condition and changing the value of the stored voltage during an under-voltage condition.

16. The method of claim 8 wherein sampling and storing the value of the output of the error amplifier at the zero crossing of the AC voltage includes detecting the zero crossing and enabling a switch to couple the output of the error amplifier to a storage element.

17. A power factor correction device comprising:

an error amplifier having a first input coupled to receive a first reference voltage, a second input coupled to receive a feedback voltage, and an output coupled to provide a deviation voltage;

a storage node;

a voltage return;

a storage element having a first terminal coupled to the storage node and a second terminal coupled to the voltage return; and a zero crossing detector having an input coupled to receive an AC signal and an output coupled to responsively adjust, during a zero crossing of the AC signal, a value of a voltage stored on the storage element by coupling the deviation voltage to the storage element within no greater than twenty degrees of the zero crossing.

18. A power factor correction device comprising:

an error amplifier having a first input coupled to receive a first reference voltage, a second input coupled to receive a feedback voltage, and an output;

a storage node:

a voltage return;

a storage element having a first terminal coupled to the storage node and a second terminal coupled to the voltage return; and a zero crossing detector having an input coupled to receive an AC signal and an output coupled to responsively adjust, during a zero crossing of the AC signal, a value of a voltage stored on the storage element, the zero crossing detector including a switch having a first terminal coupled to the output of the error amplifier, a control terminal coupled to the output of the zero crossing detector, and a second terminal coupled to the storage node.

19. The power factor correction device of claim 18 wherein the zero crossing detector having the input coupled to receive the AC signal and the output coupled to adjust, during the zero crossing of the AC signal, the value of the voltage stored on the storage element includes the error amplifier having a switched current source output stage and the output of the zero crossing detector coupled to the switched current source output stage to switch a plurality of current sources to the output of the error amplifier during the zero crossing of the AC signal.

20. The power factor correction device of claim 18 further including an over-voltage amplifier having a first input coupled to receive a second reference voltage, a second input coupled to receive the feedback voltage, and an output coupled to the storage node and also including an under-voltage amplifier having a first input coupled to receive a third reference voltage, a second input coupled to receive the feedback voltage, and an output coupled to the storage node.

* * * * *